US006791397B2

(12) United States Patent
Shimozono

(10) Patent No.: US 6,791,397 B2
(45) Date of Patent: Sep. 14, 2004

(54) CONSTANT CURRENT CIRCUIT FOR CONTROLLING VARIATION IN OUTPUT CURRENT DUTY CAUSED BY THE INPUT CAPACITANCE OF A CURRENT MIRROR CIRCUIT

(75) Inventor: Masahiro Shimozono, Kitakyushu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/253,878

(22) Filed: Sep. 25, 2002

(65) Prior Publication Data

US 2003/0071677 A1 Apr. 17, 2003

(30) Foreign Application Priority Data

Sep. 26, 2001 (JP) ..... P2001-293921

(51) Int. Cl.[7] ..... G05F 1/10
(52) U.S. Cl. ..... 327/543; 327/538; 323/315
(58) Field of Search ..... 327/538, 540, 327/541, 543; 323/312, 315

(56) References Cited

U.S. PATENT DOCUMENTS 3,924,143 A * 12/1975 Cunningham et al. ..... 327/170
4,127,783 A * 11/1978 Alaspa ..... 327/538
6,448,844 B1 * 9/2002 Cho ..... 327/538
6,452,453 B1 * 9/2002 Fujioka et al. ..... 330/288

FOREIGN PATENT DOCUMENTS

JP 2001-154748 6/2001

* cited by examiner

*Primary Examiner*—Terry D. Cunningham
(74) *Attorney, Agent, or Firm*—Oblon, Spivak, McClelland, Maier & Neustadt, P.C.

(57) ABSTRACT

A constant current circuit delivering a constant current to a load connected between first and second output terminals comprises, a reference current generator configured to generate a reference current, a current mirror circuit configured to amplify the reference current, an output transistor configured to deliver the constant current based on an output of the current mirror circuit, a signal source configured to deliver a pulse control signal, an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

19 Claims, 6 Drawing Sheets

CONSTANT CURRENT CIRCUIT FOR CONTROLLING VARIATION IN OUTPUT CURRENT DUTY CAUSED BY THE INPUT CAPACITANCE OF A CURRENT MIRROR CIRCUIT

CROSS REFERENCE TO RELATED APPLICATIONS

This application is based upon and claims the benefit of priority from the prior Japanese Patent Applications No. P2001-293921, filed on Sep. 26, 2001; the entire contents of which are incorporated herein by reference.

BACKGROUND OF THE INVENTION

1. Field of the Invention

The present invention relates to a constant current circuit switching a output current.

2. Description of the Related Art

A constant current circuit outputting a constant current irrespective of an external output voltage is used in a driver of a light emitting diode (LED). For instance, the constant current circuit is installed in a device turning on and off an LED, or a control unit of a display device having an array of LEDs.

A current mirror circuit having no temperature dependency, and always outputting a stabile current, is used in a conventional constant current circuit. The current mirror circuit connects the base terminals of two transistors together, and further connects the base terminal to a collector terminal of one of the transistors together. A current flowing into one of the transistors is treated as a reference current, and the other transistor conducts a current equal to the reference current amplified by a constant magnification.

However, in the conventional constant current circuit, as the switching rate increases and/or the current decreases, there is a problem that output current duty varies according to the input capacitance of the base terminal of the transistor used for the current mirror circuit.

SUMMARY OF THE INVENTION

In a first aspect of the present invention, a constant current circuit comprises, a reference current generator outputting a reference current, a current mirror circuit outputting an amplification signal of the reference current, an output transistor outputting a constant current to the load based on an amplification signal of the current mirror circuit, a signal source outputting a pulse control signal, an auxiliary switching circuit having a switch terminal outputting a switch signal in response to the pulse control signal, and a discharge terminal outputting a discharge signal to an input side of the current mirror circuit when the switch signal is stopped; and a switch circuit turning off the output transistor when the switch signal is provided.

In a second aspect of the present invention, a semiconductor integrated circuit comprises a semiconductor chip, a reference voltage source integrated on the semiconductor chip and outputting a reference voltage, an amplifier circuit integrated on the semiconductor chip, and inputting the reference voltage and performing impedance conversion, a voltage-current converter integrated on the semiconductor chip, and outputting a reference current based on the reference voltage outputted from the amplifier circuit, a current mirror circuit integrated on the semiconductor chip, and amplifying the reference current and outputting the resulting current, an output transistor integrated on the semiconductor chip and outputting a constant current to the load based on an output signal of the current mirror circuit, a signal source integrated on the semiconductor chip and outputting a pulse control signal, an auxiliary switching circuit integrated on the semiconductor chip, and having a switch terminal outputting a switch signal in response to the pulse control signal, and a discharge terminal outputting a discharge signal to an input side of the current mirror circuit when the switch signal is stopped, and a switch circuit integrated on the semiconductor chip, and turning off the output transistor when the switch signal is provided.

DETAILED DESCRIPTION OF THE INVENTION

Figure 1:
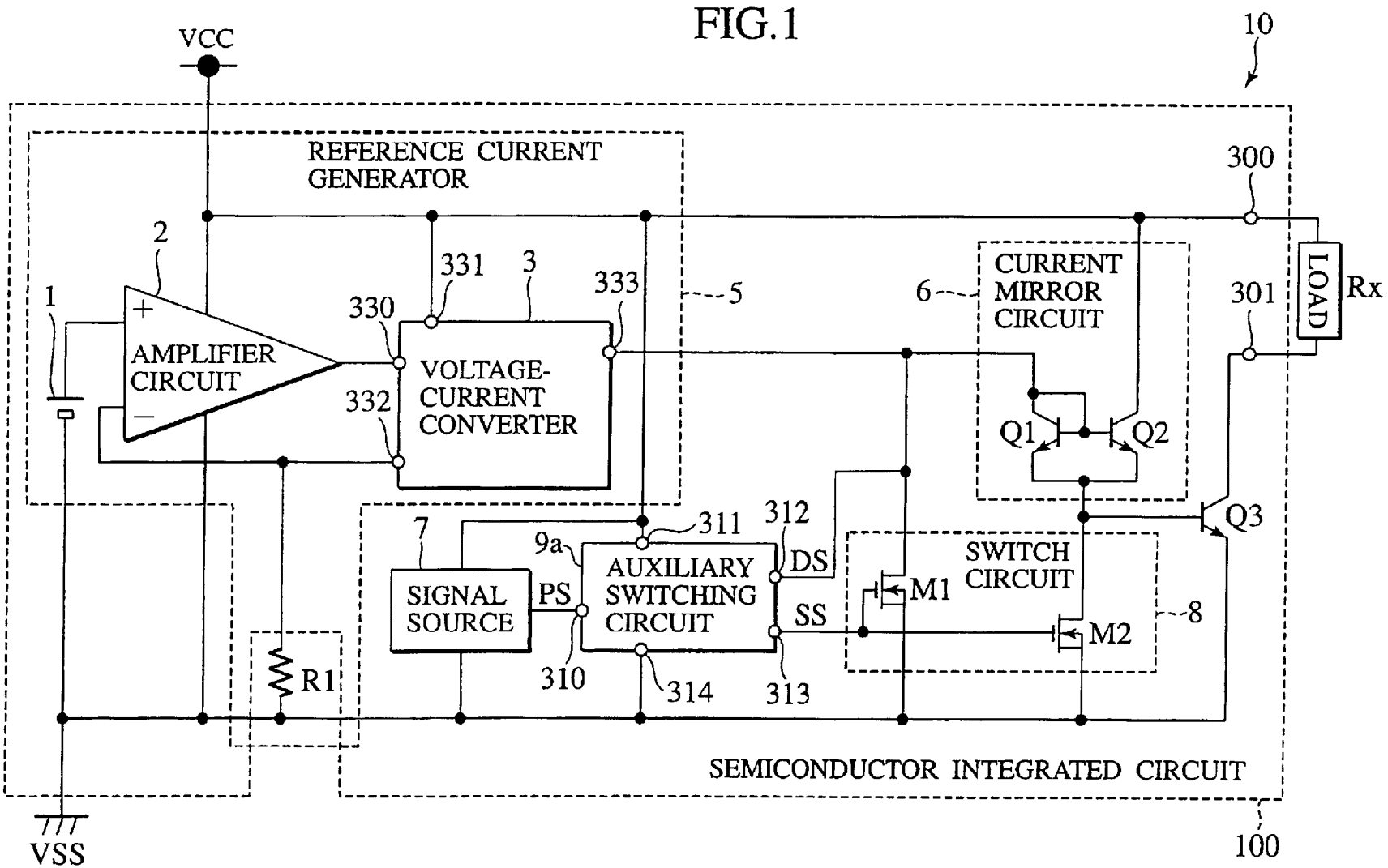
FIG. 1 is a circuit diagram of a constant current circuit according to a first embodiment of the present invention.

Various embodiments of the present invention will be described with reference to the accompanying drawings. It is to be noted that the same or similar reference numerals are applied to the same or similar parts and elements throughout the drawings, and description of the same or similar parts and elements will be omitted or simplified. In the following descriptions, numerous specific details are set forth such as specific signal values, etc. to provide a thorough understanding of the present invention. However, it will be obvious to those skilled in the art that the present invention may be practiced without such specific details. In other instances, well-known circuits have been shown in block diagram form in order not to obscure the present invention with unnecessary detail. In the following description, a word "connect" defines a state in which first and second elements are electrically connected to each other without regard to whether or not there is a physical connection between the elements.

First Embodiment

As shown in FIG. 1, a constant current circuit 10 according to a first embodiment of the present invention delivers a constant current to a load Rx connected between first output terminal 300 and second output terminal 301 encompasses, a reference current generator 5 generating a reference current, a current mirror circuit 6 configured to amplify the reference current, an output transistor Q3 configured to deliver the constant current based on an output of the current mirror circuit 6, a signal source 7 configured to deliver a pulse control signal PS, an auxiliary switching circuit 9*a* having a switch terminal 313 configured to deliver a switch signal SS in response to the pulse control signal PS, and a discharge terminal 312 configured to deliver a discharge signal DS to the current mirror circuit 6 when the switch signal SS is stopped; and a switch circuit 8 configured to turn off the output transistor Q3 with receiving the switch signal SS.

The reference current generator 5, the signal source 7, and the auxiliary switching circuit 9*a* are connected between a high voltage power supply VCC and a low voltage power supply VSS.

Figure 2:
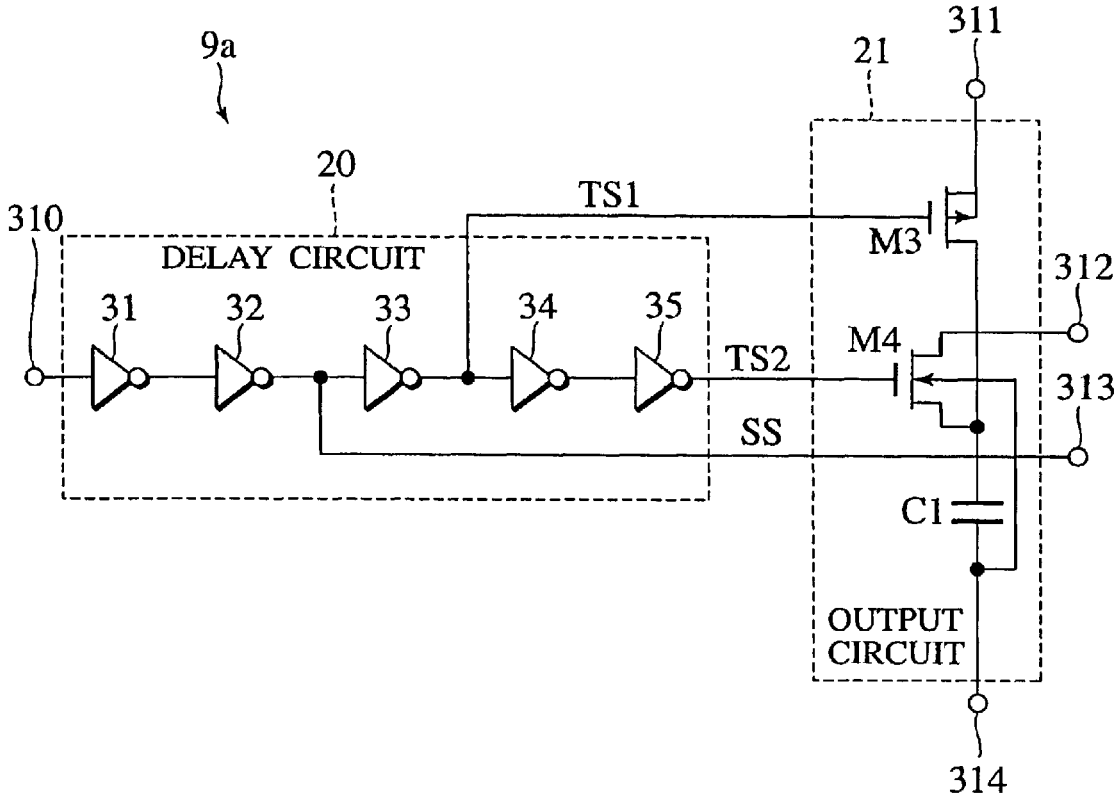
FIG. 2 is a circuit diagram of an auxiliary switching circuit according to the first embodiment of the present invention.

As shown in FIG. 2, the auxiliary switching circuit 9*a* in FIG. 1 embraces a delay circuit 20 and an output circuit 21 connected to an output side of the delay circuit 20.

The delay circuit 20 includes a first inverter 31 (first-stage inverter) having an input terminal connected to a control signal input terminal 310, a second inverter 32 having an input terminal connected to an output terminal of the first inverter 31, a third inverter 33 (mid-stage inverter) having an input terminal connected to an output terminal of the second inverter 32 and a switch terminal 313, a fourth inverter 34 having an input terminal connected to an output terminal of the third inverter 33, and a fifth inverter 35 (last-stage inverter) having an input terminal connected to an output terminal of the fourth inverter 34. Here, the inverters 31,32, 33,34,35 are serially connected in five stages but are not limited to being five stages.

The output circuit 21 includes a charge transistor (pMOS transistor) M3 having a gate terminal connected to the output terminal of the third inverter 33, and a source terminal connected to the high voltage power supply terminal 311, a discharge transistor (nMOS transistor) M4 having a gate terminal connected to an output terminal of the fifth inverter 35, a drain terminal connected to a discharge terminal 312, a source terminal connected to a drain terminal of the charge transistor M3, and a back gate terminal connected to a low voltage power supply terminal 314, and a charge capacitor C1 connected between a low voltage power supply terminal 314 and the drain terminal of the discharge transistor M4.

As shown in FIG. 1, the current mirror circuit 6 includes a first transistor Q1 having a collector terminal and a base terminal connected to the output side of the reference current generator 5, and an emitter terminal connected to a base terminal of the output transistor Q3, and a second transistor Q2 having a base terminal and an emitter terminal connected to the base terminal and the emitter terminal of the first transistor Q1.

The switch circuit 8 includes a first switch transistor (nMOS transistor) M1 having a gate terminal connected to the switch terminal 313, a drain terminal connected to an input side of the current mirror circuit 6, and a source terminal connected to the low voltage power supply VSS, and a second switch transistor (nMOS transistor) M2 having a gate terminal connected to the switch terminal 313, a drain terminal connected to an output side of the current mirror circuit 6 and the base terminal of the output transistor Q3, and the source terminal connected to the low voltage power supply VSS.

The reference current generator 5 includes a reference voltage source 1 having a negative electrode connected to a low voltage power supply VSS and appositive electrode connected to the high voltage power supply VCC, an amplifier circuit 2 having a positive input terminal connected to a positive electrode of the reference voltage source 1, a voltage-current converter 3 having a voltage input terminal 330 connected to an output terminal of the amplifier circuit 2, and a resistor connection terminal 332 connected to a negative input terminal of the amplifier circuit 2, and a current setting resistor R1 connected between the resistor connection terminal 332 and the low voltage power supply VSS.

Figure 3:
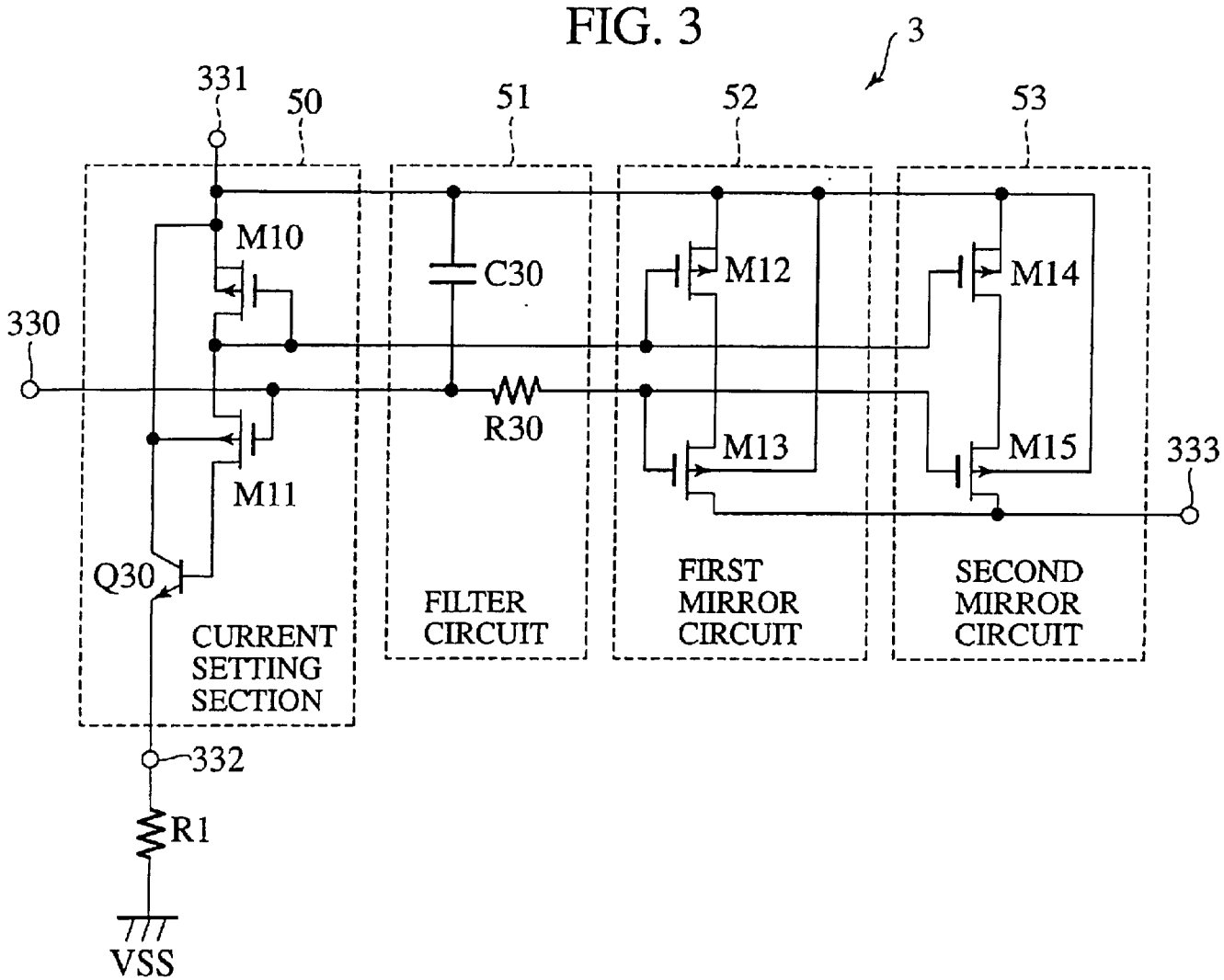
FIG. 3 is a circuit diagram of a voltage-current converter according to the first embodiment of the present invention.

As shown in FIG. 3, the voltage-current converter 3 includes a current setting section 50 connected to a voltage input terminal 330, a high voltage power supply terminal 331, and the resistor connection terminal 332, a filter circuit 51 connected to an output side of the current setting section 50, a first mirror circuit 52 connected to an output side of the filter circuit 51, and a second mirror circuit 53 having an input side connected to an output side of the first mirror circuit 52, and an output side connected to a current output terminal 333. The current setting section 50 embraces a first current setting transistor (pMOS transistor) M10 having a source terminal connected to the high voltage power supply terminal 331, a second current setting transistor (pMOS transistor) M11 having a gate terminal connected to the voltage input terminal 330, a drain terminal connected to a drain terminal and a gate terminal of the first current setting transistor M10, and a back gate terminal connected to the high voltage power supply terminal 331, and a third current setting transistor Q30 having a collector terminal connected to the high voltage power supply terminal 331, a base terminal connected to a source terminal of the second current setting transistor M11, and an emitter terminal connected to the resistor connection terminal 332.

The filter circuit 51 shown in FIG. 3 includes a gain adjustment capacitor C30 connected between the high voltage power supply terminal 331 and the voltage input terminal 330, and a gain adjustment resistor R30 having a terminal connected to the voltage input terminal 330 so as to form a RC filter. The first mirror circuit 52 encompasses a first mirror transistor (pMOS transistor) M12 having a source terminal connected to the high voltage power supply terminal 331, and a gate terminal connected to the drain terminal and the gate terminal of the first current setting transistor M10, and a second mirror transistor (pMOS transistor) M13 having a drain terminal connected to a drain terminal of the first mirror transistor M12, a gate terminal connected to the other terminal of the gain adjustment resistor R30, and a source terminal connected to the current output terminal 333. The second mirror circuit 53 encompasses a third mirror transistor (pMOS transistor) M14 having a source terminal connected to the high voltage power supply terminal 331, a gate terminal connected to the drain terminal and the gate terminal of the first current setting transistor M10, and a fourth mirror transistor (pMOS transistor) M15 having a drain terminal connected to a drain terminal of the third mirror transistor M14, a gate terminal connected to the other terminal of the gain adjustment resistor R30, and a source terminal connected to the current output terminal 333.

Figure 4:
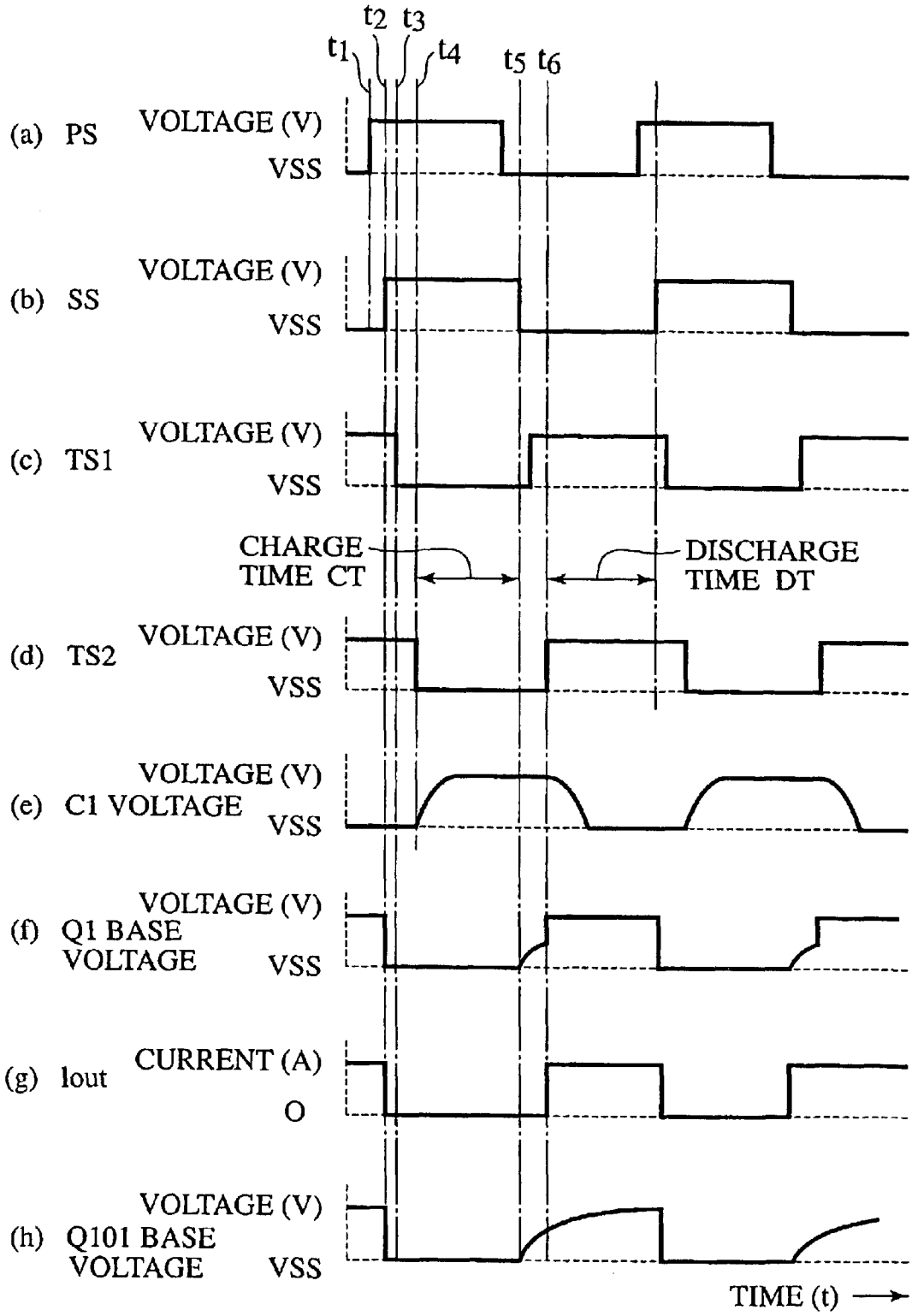
FIG. 4 is a diagram for describing the operational timing of the constant current circuit according to the first embodiment of the present invention.

Operation of the constant current circuit 10 according to the first embodiment of the present invention is described using the timing chart shown in FIG. 4.

(A) To begin with, the amplifier circuit 2 shown in FIG. 1 inputs a reference voltage outputted from the reference voltage source 1, and outputs a constant voltage from the output terminal. As the constant voltage is fed to the voltage input terminal 330 from the amplifier circuit 2, the second current setting transistor M11 and the third current setting transistor Q30 shown in FIG. 3 are turned on. When the third current setting transistor Q30 is turned on, the current flows into the current setting resistor R1. Let "n" be a current amplification factor of the third current setting transistor Q30, a current flowing to the base terminal of the third current setting transistor Q30 is (1/n) times the current flows into the current setting resistor R1. In this case, a current outputted to the output sides of the first mirror circuit 52 and second mirror circuit 53 is proportional to the current flowing into the base terminal of the third current setting transistor Q30 respectively. In other words, output terminal 333 outputs the reference current at (2/n) times the current flowing into the current setting resistor R1.

(B) Next, as shown in FIG. 4(*a*), the pulse control signal PS inputted to the input side of the auxiliary switching circuit 9*a* from the signal source 7, becomes a high level signal at time point t1. As shown, the pulse control signal PS is a pulse-shaped waveform. At this point, the switch signal SS outputted from the output terminal of the second inverter 32 is low, and the switch circuit 8 is turned off. Also, the first control signal TS1 outputted from the output terminal of the third inverter 33 is high, and the charge transistor M3 is turned off. The second control signal TS2 outputted from the output terminal of the fifth inverter 35 is also high, and the discharge transistor M4 is turned on.

(C) Then, shown in FIG. 4(*b*), after the pulse control signal PS is inputted, the switch signal SS makes a transition from low to high at time point t2 after the time delay of two stages of the inverters has passed. Following the transition of the switch signal SS to a high level, the first switch transistor M1 and second switch transistor M2 are turned on, and the input side and output side of the current mirror circuit 6 are connected to the low voltage power supply VSS, and turned off. When the current mirror circuit 6 turns off, the base current is not supplied to the output transistor, and the current outputted to the load Rx is halted.

(D) Next, as shown in FIG. 4(*c*), the first control signal TS1 changes from high to low at time point t3, after a time delay equivalent to one stage of the inverters has passed from time t2.

(E) Then, as shown in FIG. 4(*d*), the second control signal TS2 changes from high to low at time point t4, after a time delay equivalent to three stages of the inverters has elapsed. Following the transition of the second control signal TS2 from a high to a low level, the discharge transistor M4 turns off, and the charge capacitor C1 begins to charge.

(F) Subsequently, as shown in FIG. 4(*b*), the switch signal SS makes a transition from high to low at time point t5, after a time delay equivalent to two stages of the inverters has passed following the transition of the pulse control signal PS from a high to a low level. Following the transition of the switch signal SS to a low level, the first switch transistor M1 and second switch transistor M2 are turned off.

(G) As shown in FIG. 4(*d*), the discharge transistor M4 turns on at time point t6, and the voltage of the charge capacitor C1 charged is supplied to the common base of the first transistor Q1 and second transistor Q2 of the current mirror circuit 6. In the case having no auxiliary switching circuit 9*a*, as shown in FIG. 4(*h*), the voltage climbs gradually according to the input capacitor of the first transistor Q1 and the second transistor Q2. Conversely, in the case where there is an auxiliary switching circuit 9*a* such as in the constant current circuit 10 shown in FIG. 2, the rising of the voltage is corrected as shown in FIG. 4(*f*). In addition, the first switch transistor M1 and the second switch transistor M2 simultaneously turn off. As the second switch transistor turns off, current is supplied to the output transistor, and as shown in FIG. 4(*g*), a constant current is supplied to the load Rx connected between the first output terminal 300 and second output terminal 301.

Nevertheless, with the operational timing charts of the constant current circuit 10 shown in FIG. 4, operation of the constant current circuit 10 is described schematically without taking into consideration the voltage step-down between each electrode of the transistors. For example, in the case of operating with 5 V output voltage, the voltage of the charge capacitor C1 shown in FIG. 4(*e*) does not actually fall to the low voltage power supply VSS, but only falls to approximately 1.4 V in conformity with the threshold voltage for two transistors Q1, M4.

In addition, it is preferable that the first control signal TS1 controlling the charge transistor M3, and the second control signal TS2 controlling the discharge transistor M4, charge the charge capacitor C1 when the switch circuit 8 is turned on, and discharge when it is turned off. In other words, the order of the first control signal TS1 and the second control signal TS2 is not limited to that described above.

With the constant current circuit according to the first embodiment of the present invention, it is possible to control the variation in output current duty caused by the input capacitor of the transistor base terminal used in the current mirror circuit, even if the switching rate increases and/or the current decreases.

Figure 5:
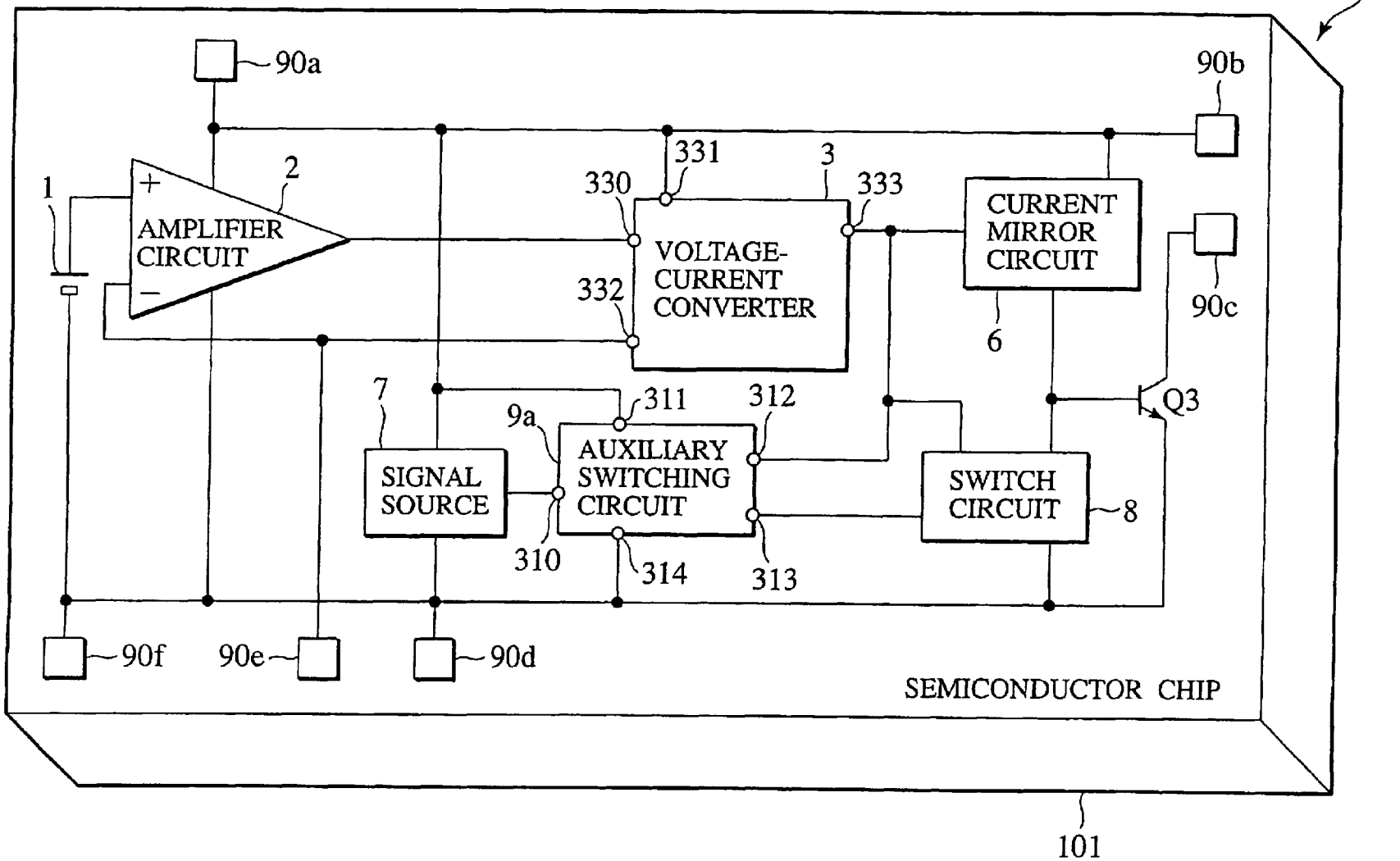
FIG. 5 is a diagram for describing a semiconductor integrated circuit merging the constant current circuit shown in FIG. 1.

A part of the constant current output circuit 10 embracing an auxiliary circuit 9*a* according to the first embodiment of the present invention can be the monolithically integrated so as to form the semiconductor integrated circuit 100 on the same semiconductor chip 101 as shown in FIG. 5.

In this case, the reference voltage source 1, the amplifier circuit 2, the voltage-current converter 3, the current mirror circuit 6, the signal source 7, the switch circuit 8, the auxiliary switching circuit 9*a*, and the output transistor are merged in the semiconductor chip 101.

The semiconductor chip 101 has a bonding pad 90*a* configured to be connect with the high voltage power supply VCC. The bonding pad 90*a* is electrically connected internally to the reference voltage source 1, the amplifier circuit 2, the voltage-current converter 3, the current mirror circuit 6, the signal source 7, the switch circuit 8, and the auxiliary switching circuit 9*a*.

The semiconductor chip 101 also has a bonding pad 90*b* configured to supply output current to the externally connected load Rx, and is electrically connected internally to the amplifier circuit 2, the voltage-current converter 3, the current mirror circuit 6, the signal source 7, and the auxiliary switching circuit 9*a*.

The semiconductor chip 101 also has a bonding pad 90*c* configured to receive current from the externally connected the load Rx. The bonding pad 90*c* is electrically connected to the collector terminal of the output transistor Q3.

The semiconductor chip 101 also has a bonding pad 90*d* configured to connect to one of the terminals of the current adjustment resistor R1 as showed in FIG. 1. The bonding pad 90*d* is electrically connected to the reference voltage source 1, the amplifier circuit 2, the signal source 7, the switch circuit 8, the auxiliary switching circuit 9*a*, and the emitter terminal of the output transistor Q3.

The semiconductor chip 101 also has a bonding pad 90*e* configured to connect to the other terminal of the current adjustment resistor R1 as showed in FIG. 1. The bonding pad 90*e* is electrically connected to the amplifier circuit 2, the voltage-current converter 3.

The semiconductor chip 101 also has a bonding pad 90*f* configured to connect to the low voltage power supply VSS. The bonding pad 90*f* is electrically connected to the amplifier circuit 2, the voltage-current converter 3.

The bonding pad 90*a*, the bonding pad 90*b*, the bonding pad 90*c*, the bonding pad 90*d*, the bonding pad 90*e*, and the bonding pad 90*f* are an internal terminal formed on the semiconductor chip 101.

Meanwhile, the positive electrode side of the reference voltage source 1 is electrically connected to a positive input terminal of amplifier circuit 2. The output terminal of amplifier circuit 2 is electrically connected to voltage input terminal 330 of the voltage-current converter 3. The resistor connection terminal 332 of the voltage-current converter 3 is electrically connected to the negative input terminal of the amplifier circuit 2. The output side of the voltage-current converter 3 is electrically connected to the input side of the current mirror circuit 6. The output side of the current mirror circuit 6 is electrically connected to the base terminal of the output transistor Q3. The output side of the signal source 7 and the input side of the auxiliary switching circuit 9 are electrically connected. The switch terminal 313 of the auxiliary switching circuit 9*a* and the input side of the switch circuit 8, and the discharge terminal 312 of the auxiliary switching circuit and the input side of the current mirror circuit 6 are electrically connected.

The semiconductor chip 101 shown in FIG. 5 is implemented by known CMOS process. More specifically, the bonding pads 90*a*, 90*b*, 90*c* . . . 90*f* are connected to, for example, a plurality of high impurity concentration regions (source region/drain region) formed in and at the surfaces of active are as assigned at the surface of the semiconductor chip 101, where a donor or an acceptor is doped with a concentration of approximately $1\times10^{18}$ to $1\times10^{21}$ $cm^{-3}$. A plurality of electrode layers made from a metal such as aluminum (Al) or an aluminum alloy (Al—Si, Al—Cu—Si) are formed so as to implement ohmic contacts with this plurality of high impurity concentration regions. On the top surface of such a plurality of electrode layers, a passivation film such as an oxide film ($SiO_2$), a phosphosilicate glass (PSG) film, a boro-phosphosilicate glass (BPSG) film, a nitride film ($Si_3N_4$), or a polyimide film, is deposited.

A plurality of openings (contact holes) are delineated in a portion of the passivation film so as to expose a plurality of electrode layers, implementing the bonding pads 90*a*, 90*b*, 90*c* through 90*f*. Alternatively, the bonding pads 90*a*, 90*b*, 90*c* through 90*f* may be formed as other metal patterns connected to a plurality of electrode layers by using metal wiring. In addition, it is possible to form bonding pads 90*a*, 90*b*, 90*c* through 90*f* on the polysilicon gate electrodes using a metal film such as aluminum (Al) or an aluminum alloy (Al—Si, Al—Cu—Si). Alternatively, a plurality of other bonding pads may be connected, via a plurality of signal lines such as gate wirings, to the polysilicon gate electrodes. Instead of polysilicon, gate electrodes made of a refractory metal such as tungsten (W), titanium (Ti), or molybdenum (Mo), a silicide (i.e. $WSi_2$, $TiSi_2$, $MoSi_2$), or a polycide containing any of these silicides can be used.

Second Embodiment

Figure 6:
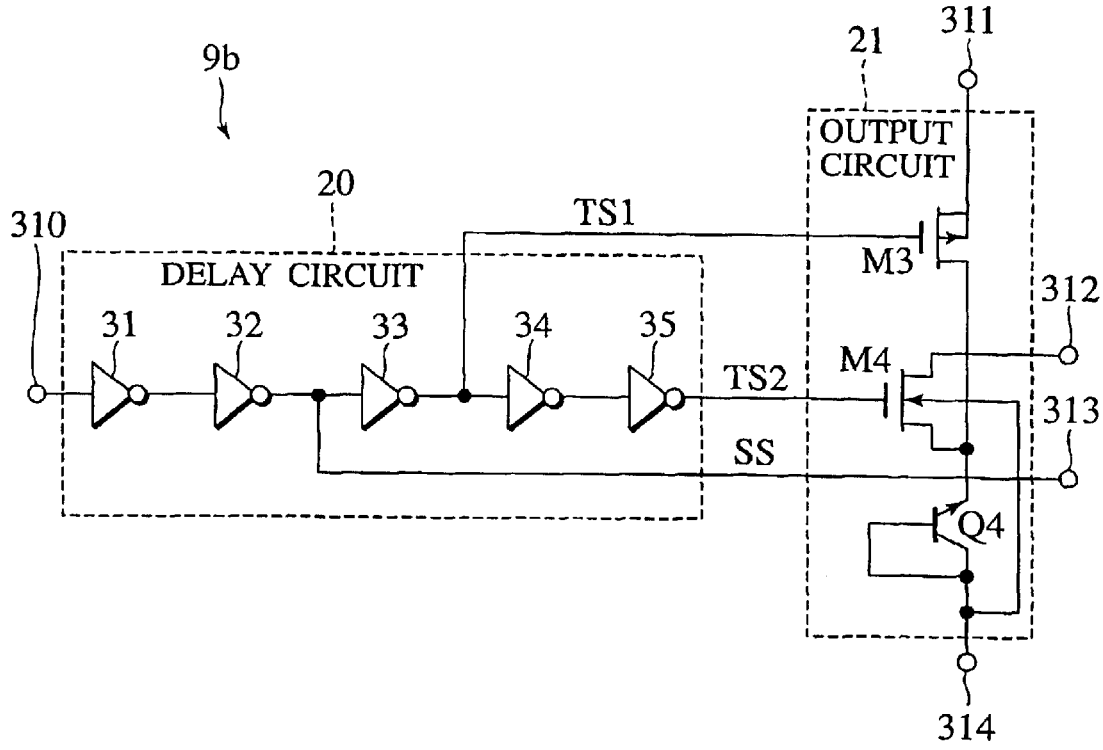
FIG. 6 is a circuit diagram illustrating a configuration of an auxiliary switching circuit used for a constant current circuit according to a second embodiment of the present invention.

As shown in FIG. 6, in an auxiliary switching circuit 9*b* used as part of a constant current circuit 10 according to a second embodiment, the charge capacitor C1 shown in FIG. 2 is replaced with a diode-connected capacitor transistor (npn-type transistor) Q4. The capacitor transistor Q4 has an emitter terminal connected to the drain terminals of the charge transistor M3 and discharge transistor M4, respectively, and a collector terminal and a base terminal connected to a low voltage power supply terminal 314. The other aspects are substantially similar to the first embodiment, and accordingly, redundant description is omitted.

In the auxiliary switching circuit 9*b* used in the constant current circuit 10 according to the second embodiment of the present invention, following the high-level transition of the pulse control signal PS input to the inputted side of the auxiliary switching circuit 9*b* from the signal source 7, the switch circuit 8 turns on, and input/output of the current mirror circuit 6 falls to the low voltage power supply VSS level. Once the input/output of the current mirror circuit 6 becomes the low voltage power supply VSS level, the output transistor Q3 turns off, and the current supply to the load Rx is halted. Next, following the high-level transition of the pulse control signal PS inputted to the input side of the auxiliary switching circuit 9*b* from the signal source 7, a discharge signal DS outputted to the input side of the current mirror circuit 6 is timed to occur with the switch circuit 8 transition from on to off. With the auxiliary switching circuit 9*b* used for the constant current circuit 10 according to the second embodiment of the present invention, it is possible to control variation in the output current duty caused by the input capacitor of the transistor base terminal used for the current mirror circuit, even if the switching rate increases and/or the current decreases.

It is also possible to cancel the input capacitor more precisely by making the input capacitor of the capacitor transistor Q4 used for the auxiliary switching circuit 9*b*, and the input capacitor of the first transistor Q1 or the second transistor Q2 of the current mirror circuit 6 substantially equal.

Third Embodiment

Figure 7:
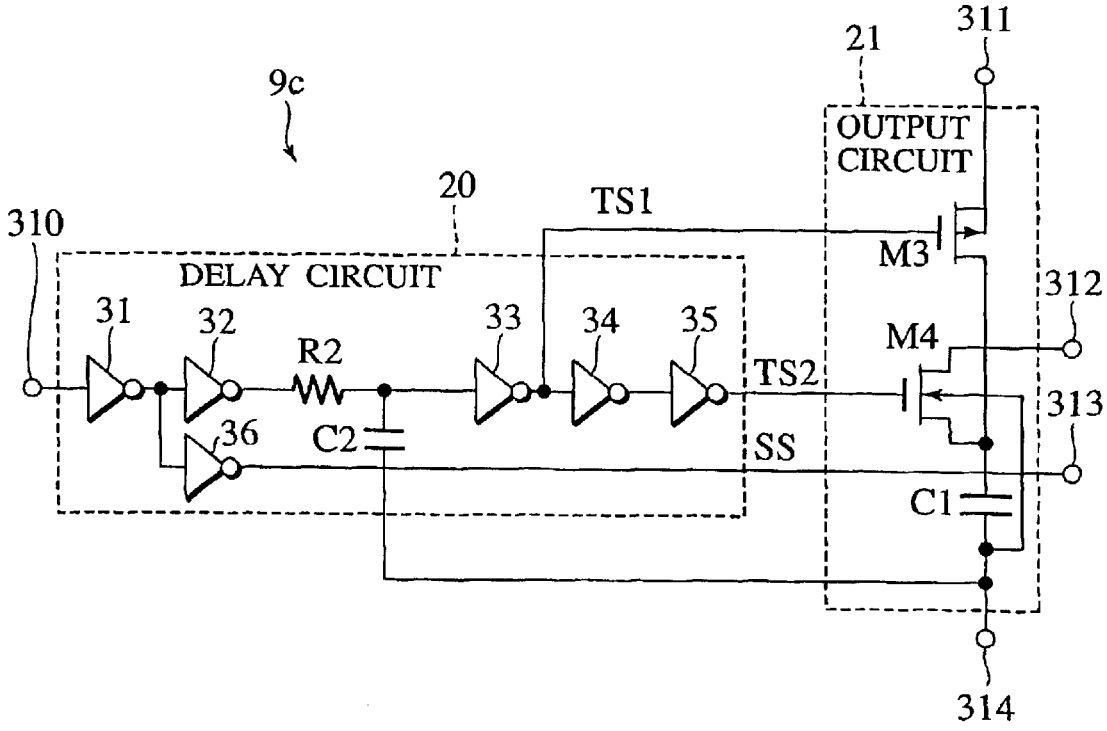
FIG. 7 is a circuit diagram illustrating a configuration of an auxiliary switching circuit used in a constant current circuit according to a third embodiment of the present invention.

As shown in FIG. 7, in an auxiliary switching circuit 9*c* used as part of the constant current circuit 10 according to a third embodiment, a time-constant setting resistor R2 is inserted in series between the output terminal of the second inverter 32 and the input terminal of the third inverter 33. In addition, a time-constant setting capacitor C2 is provided between the input terminal of the third inverter 33 and the low voltage power supply terminal 314. The input terminal of the sixth inverter 36 is connected to the output terminal of the first inverter 31, and the switch terminal 313 is connected to the output terminal of the sixth inverter 36. Other aspects are substantially similar to the first embodiment, and accordingly, redundant description is omitted.

In the auxiliary switching circuit 9*c* used in the constant current circuit 10 according to the third embodiment of the present invention, to begin with, following high-level transition of the pulse control signal PS inputted to the input side of the auxiliary switching circuit 9*c* from the signal source 7, the switch circuit 8 turns on, and input/output of the current mirror circuit 6 falls to a low voltage power supply VSS level. Once the input/output of the current mirror circuit 6 becomes the low voltage power supply VSS level, the output transistor Q3 turns off, and current supply to the load Rx is halted. Next, following the high-level transition of the pulse control signal PS inputted to the input side of the auxiliary switching circuit 9*c* from the signal source 7, the discharge signal DS is outputted to the input side of the current mirror circuit 6 as the switch circuit 8 changes from on to off.

With the auxiliary switching circuit 9*c* used in the constant current circuit 10 according to the third embodiment of the present invention, it is possible to control variation in the output current duty caused by the input capacitor of the base terminal of the transistor used for the current mirror circuit 6, even if the switching rate increases, and/or the current decreases. It is also possible to adjust the timing of charging and discharging by varying the time-constant setting resistor R2 and time constant setting capacitor C2 values.

Various modifications will become possible for those skilled in the art after receiving the teachings of the present disclosure without departing from the scope thereof.

What is claimed is:

1. A constant current circuit delivering a constant current to a load connected between first and second output terminals, comprising:

a reference current generator configured to generate a reference current;

a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped, including:

a delay circuit configured to receive the pulse control signal so as to deliver the switch signal, a first control signal delayed from the switch signal, and a second control signal delayed from the first control signal; and an output circuit configured to deliver the discharge signal to the discharge terminal, a switch circuit configured to turn off the output transistor with receiving the switch signal.

2. A constant current circuit delivering a constant current to a load connected between first and second output terminals, comprising:

a reference current generator configured to generate a reference current;

a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped, including:

a delay circuit configured to receive the pulse control signal so as to deliver the switch signal, a first control signal delayed from the switch signal, and a second control signal delayed from the first control signal, having an odd number of inverters connected in series configured to deliver the first control signal having an opposite phase of the pulse control signal from a mid-stage inverter connected to an inverter positioned in even-numbered stages following a first-stage inverter, and configured to deliver the second control signal having the opposite phase of the pulse control signal from a last-stage inverter, an output circuit configured to deliver the discharge signal to the discharge terminal; and a switch circuit configured to turn off the output transistor with receiving the switch signal.

3. A constant current circuit delivering a constant current to a load connected between first and second output terminals, comprising:

a reference current generator configured to generate a reference current;

a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped, including:

a delay circuit configured to receive the pulse control signal so as to deliver the switch signal, a first control signal delayed from the switch signal, and a second control signal delayed from the first control signal;

an output circuit configured to deliver the discharge signal to the discharge terminal having:

a charge transistor having a drain terminal, a gate terminal configured to receive the first control signal, a source terminal connected to a high voltage power supply terminal;

a discharge transistor having a gate terminal configured to receive the second control signal, and having a source terminal connected to the discharge terminal, and a drain terminal connected to the drain terminal of the charge transistor;

a charge capacitor connected between a low voltage power supply terminal and the drain terminal of the discharge transistor, and a switch circuit configured to turn off the output transistor with receiving the switch signal.

4. A constant current circuit delivering a constant current to a load connected between first and second output terminals, comprising:

a reference current generator configured to generate a reference current;

a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped, including:

delay circuit configured to receive the pulse control signal so as to deliver the switch signal, a first control signal delayed from the switch signal, and a second control signal delayed from the first control signal;

an output circuit configured to deliver the discharge signal to the discharge terminal having:

a charge transistor having a drain terminal, a gate terminal configured to receive the first control signal, a source terminal connected to a high voltage power supply terminal;

a discharge transistor having a gate terminal configured to receive the second control signal, and having a source terminal connected to the discharge terminal, and a drain terminal connected to the drain terminal of the charge transistor; and a charge capacitor connected between a low voltage power supply terminal and the drain terminal of the discharge transistor, and is an input capacitor of a base terminal of a diode-connected transistor; and a switch circuit configured to turn off the output transistor with receiving the switch signal.

5. A constant current circuit delivering a constant current to a load connected between first and second output terminals, comprising:

a reference current generator configured to generate a reference current;

a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped;

a switch circuit configured to turn off the output transistor with receiving the switch signal, including:

a first switch transistor having a gate terminal connected to the switch terminal, a drain terminal connected to an input side of the current mirror circuit, and a source terminal connected to a low voltage power supply; and a second switch transistor having a gate terminal connected to the switch terminal, a drain terminal connected to an output side of the current mirror circuit and a base terminal of the output transistor, and a source terminal connected to the low voltage power supply.

6. A constant current circuit delivering a constant current to a load connected between first and second output terminals, comprising:

a reference current generator configured to generate a reference current;

a current mirror circuit configured to amplify the reference current;

an output transistor configured to deliver the constant current based on an output of the current mirror circuit, including:

a first transistor having a collector terminal and a base terminal connected to an output side of the reference current generator, and an emitter terminal connected to a base terminal of the output transistor;

a second transistor having a base terminal and an emitter terminal connected to the base terminal and the emitter terminal of the first transistor, a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

7. A constant current circuit delivering a constant current to a load connected between first and second output terminals, comprising:

a reference current generator configured to generate a reference current, including:

a reference voltage source having a negative electrode connected to a low voltage power supply;

an amplifier circuit having a positive input terminal connected to a positive electrode of the reference voltage source;

a voltage-current converter having a voltage input terminal connected to an output terminal of the amplifier circuit, and a resistor connection terminal connected to a negative input terminal of the amplifier circuit;

a current setting resistor connected between the resistor connection terminal and the low voltage power supply, a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

8. A constant current circuit delivering a constant current to a load connected between first and second output terminals, comprising:

a reference current generator configured to generate a reference current, including:

a reference voltage source having a negative electrode connected to a low voltage power supply;

an amplifier circuit having a positive input terminal connected to a positive electrode of the reference voltage source;

a voltage-current converter having a voltage input terminal connected to an output terminal of the amplifier circuit, and a resistor connection terminal connected to a negative input terminal of the amplifier circuit, having:

a current setting section connected to the voltage input terminal, a high voltage power supply terminal, and respectively;

a filter circuit connected to an output side of the current setting section;

a first mirror circuit connected to an output side of the filter circuit;

a second mirror circuit having an input side connected to an output side of the first mirror circuit, and an output side connected to a current output terminal, a current setting resistor connected between the resistor connection terminal and the low voltage power supply, a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a second mirror circuit having an input side connected to an output side of the first mirror circuit, and an output side connected to a current output terminal, a current setting resistor connected between the resistor connection terminal and the low voltage power supply, a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

9. A constant current circuit delivering a constant current to a load connected between first and second output terminals, comprising:

a reference current generator configured to generate a reference current, including:

a reference voltage source having a negative electrode connected to a low voltage power supply;

an amplifier circuit having a positive input terminal connected to a positive electrode of the reference voltage source;

a voltage-current converter having a voltage input terminal connected to an output terminal of the amplifier circuit, and a resistor connection terminal connected to a negative input terminal of the amplifier circuit, having:

a current setting section connected to the voltage input terminal, a high voltage power supply terminal, and respectively, having:

a first current setting transistor having a source terminal connected to the high voltage power supply terminal;

a second current setting transistor having a gate terminal connected to the voltage input terminal, a drain terminal connected to a drain terminal and a gate terminal of the first current setting transistor, and a back gate terminal connected to the high voltage power supply terminal;

a third current setting transistor having a collector terminal connected to the high voltage power supply terminal, a base terminal connected to a source terminal of the second current setting transistor, and an emitter terminal connected to the resistor connection terminal, a filter circuit connected to an output side of the current setting section;

a first mirror circuit connected to an output side of the filter circuit;

a second mirror circuit having an input side connected to an output side of the first mirror circuit, and an output side connected to a current output terminal, a current setting resistor connected between the resistor connection terminal and the low voltage power supply, a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

10. A constant current circuit delivering a constant current to a load connected between first and second output terminals, comprising:

a reference current generator configured to generate a reference current, including:

a reference voltage source having a negative electrode connected to a low voltage power supply;

an amplifier circuit having a positive input terminal connected to a positive electrode of the reference voltage source;

a voltage-current converter having a voltage input terminal connected to an output terminal of the amplifier circuit, and a resistor connection terminal connected to a negative input terminal of the amplifier circuit, having:

a current setting section connected to the voltage input terminal, a high voltage power supply terminal, and respectively;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

11. A constant current circuit delivering a constant current to a load connected between first and second output terminals, comprising:

a reference current generator configured to generate a reference current, including:

a reference voltage source having a negative electrode connected to a low voltage power supply;

an amplifier circuit having a positive input terminal connected to a positive electrode of the reference voltage source;

a voltage-current converter having a voltage input terminal connected to an output terminal of the amplifier circuit, and a resistor connection terminal connected to a negative input terminal of the amplifier circuit, having:

a current setting section connected to the voltage input terminal, a high voltage power supply terminal, and respectively;

a filter circuit connected to an output side of the current setting section;

a first mirror circuit connected to an output side of the filter circuit;

a second mirror circuit having an input side connected to an output side of the first mirror circuit, and an output side connected to a current output terminal, having:

a third mirror transistor having a source terminal connected to the high voltage power supply terminal, and a gate terminal connected to a drain terminal and a gate terminal of a first current setting transistor;

a fourth mirror transistor having a drain terminal connected to a drain terminal of the third mirror transistor, a gate terminal connected to the other terminal of a gain adjustment resistor, and a source terminal connected to the current output terminal, a current setting resistor connected between the resistor connection terminal and the low voltage power supply, a current mirror circuit configured to amplify the reference current;

an output transistor configured to deliver the constant current based on an output of the current mirror circuit;

a signal source configured to deliver a pulse control signal having a pulse-shaped waveform;

an auxiliary switching circuit having a switch terminal configured to deliver a switch signal in response to the pulse control signal, and a discharge terminal configured to deliver a discharge signal to the current mirror circuit when the switch signal is stopped; and a switch circuit configured to turn off the output transistor with receiving the switch signal.

12. A semiconductor integrated circuit outputting a constant current to a load connected between first and second output terminals, comprising:

a semiconductor chip;

a reference voltage source integrated on the semiconductor chip and configured to generate a reference voltage;

an amplifier circuit integrated on the semiconductor chip, and configured to receive the reference voltage and configured to perform impedance conversion;

a voltage-current converter integrated on the semiconductor chip, and configured to deliver a reference current based on the reference voltage outputted from the amplifier circuit;

a current mirror circuit integrated on the semiconductor chip, and configured to amplify the reference current;

an output transistor integrated on the semiconductor chip and configured to deliver the constant current based on an output of the current mirror circuit;

a signal source integrated on the semiconductor chip and configured to deliver a pulse control signal;

an auxiliary switching circuit integrated on the semiconductor chip, and having a switch terminal configured to deliver a switch signal in response to the pulse control signal, and a discharge terminal configured to deliver a discharge signal to an input side of the current mirror circuit when the switch signal is stopped; and a switch circuit integrated on the semiconductor chip, and configured to turn off the output transistor when the switch signal is provided.

13. The semiconductor integrated circuit of claim 12, wherein the auxiliary switching circuit comprises:

a delay circuit configured to receive the pulse control signal so as to deliver the switch signal, a first control signal delayed from the switch signal, and a second control signal delayed from the first control signal; and an output circuit configured to deliver the discharge signal the discharge terminal.

14. The semiconductor integrated circuit of claim 13, wherein the delay circuit comprises an odd number of inverters connected in series configured to deliver the first control signal having an opposite phase of the pulse control signal from a mid-stage inverter connected to an inverter positioned in even-numbered stages following a first-stage inverter, and configured to deliver the second control signal having the opposite phase of the pulse control signal from a last-stage inverter.

15. The semiconductor integrated circuit of claim 13, wherein the output circuit comprises:

a charge transistor having a drain terminal, a gate terminal configured to receive the first control signal, and a source terminal connected to a high voltage power supply terminal;

a discharge transistor having a gate terminal configured to receive the second control signal, a source terminal connected to the discharge terminal, and a drain terminal connected to the drain terminal of the charge transistor; and a charge capacitor connected between a low voltage power supply terminal and the drain terminal of the discharge transistor.

16. The semiconductor integrated circuit of claim 15, wherein the charge capacitor is an input capacitor of a base terminal of a diode-connected transistor.

17. The semiconductor integrated circuit of claim 12, wherein the voltage-current converter comprises:

a current setting section connected to a voltage input terminal, a high voltage power supply terminal, and respectively;

a filter circuit connected to an output side of the current setting section;

a first mirror circuit connected to an output side of the filter circuit; and a second mirror circuit having an input side connected to an output side of the first mirror circuit, and an output side connected to a current output terminal.

18. The semiconductor integrated circuit of claim 12, wherein the current mirror circuit comprises:

a first transistor having a collector terminal and a base terminal connected to an output side of the voltage current converter, and an emitter terminal connected to a base terminal of the output transistor; and a second transistor having a base terminal and an emitter terminal connected to a base terminal and an emitter terminal of the first transistor.

19. The semiconductor integrated circuit of claim 12, wherein the switch circuit comprises:

a first switch transistor having a gate terminal connected to the switch terminal, a drain terminal connected to an input side of the current mirror circuit, and a source terminal connected to a low voltage power supply; and a second switch transistor having a gate terminal connected to the discharge terminal, a drain terminal connected to the output side of the current mirror circuit and a base terminal of the output transistor, and a source terminal connected to the low voltage power supply.

* * * * *